US006216780B1

(12) United States Patent
Goode et al.

(10) Patent No.: US 6,216,780 B1
(45) Date of Patent: Apr. 17, 2001

(54) COILED TUBING INJECTOR WITH IMPROVED TRACTION

(75) Inventors: John Edward Goode, Arlington; Randall Scott Graves; Timothy Scott Steffenhagen, both of Ft. Worth, all of TX (US)

(73) Assignee: Hydra Rig, Inc., Fort Worth, TX (US)

( * ) Notice: Subject to any disclaimer, the term of this patent is extended or adjusted under 35 U.S.C. 154(b) by 0 days.

(21) Appl. No.: 09/491,568

(22) Filed: Jan. 26, 2000

(51) Int. Cl.[7] ..... E21B 19/22
(52) U.S. Cl. ..... 166/77.3; 166/85.5; 166/385
(58) Field of Search ..... 166/77.1, 77.3, 166/385, 77.2, 77.53, 384, 85.5

(56) References Cited

U.S. PATENT DOCUMENTS 4,655,291 * 4/1987 Cox ..... 166/385
5,553,668 * 9/1996 Council et al. ..... 166/77.3
5,566,764 * 10/1996 Elliston ..... 166/385
5,890,534 * 4/1999 Burge et al. ..... 166/77.3
5,918,671 * 7/1999 Bridges et al. ..... 166/77.3
5,975,203 * 11/1999 Payne et al. ..... 166/77.3
6,135,202 * 10/2000 Koshak ..... 166/77.1

* cited by examiner

*Primary Examiner*—Frank Tsay
(74) *Attorney, Agent, or Firm*—Marc A. Hubbard; Munsch Hardt Kopf & Harr, P.C.

(57) ABSTRACT

A coiled tubing injector includes two chains mounted for continuous, opposing rotation and aligned to grip between the continuous tubing. Behind a portion of each chain is a straight skate that presses gripper elements on the chain against the tubing as it passes between the chains. The skate includes a beam. Rollers are mounted on carriers, and the carriers slide into slots formed on the beam. A resilient pad is placed between the carriers and the beam. The gripper elements roll over the rollers as they are being pressed against the continuous tubing. Dimensional variations in gripper elements, rollers, and the roller carriers that may otherwise cause grippers to be out of alignment are accommodated by compression of the pad. Furthermore, the last roller at each end of each skate is mounted for pivoting against a spring in order to deflect as gripper elements turn into, or out of, alignment with the skate.

9 Claims, 7 Drawing Sheets

COILED TUBING INJECTOR WITH IMPROVED TRACTION

FIELD OF THE INVENTION

The invention pertains generally to apparatus for running coiled tubing in and out of bores, particularly coiled tubing injectors.

BACKGROUND OF THE INVENTION

Continuous pipe, generally known within the oil and gas industry as coiled tubing because it is stored on a large reel, has been used for many years. It is much faster to run into and out of a well bore than conventional jointed straight pipe. There is no need to connect and disconnect short segments of straight pipe.

The only method by which a continuous length of tubing can be either forced against pressure into the well, or supported while hanging in the well bore or being lowered or raised, is by continuously gripping a length of the tubing just before it enters the well bore. This method is typically practiced by arranging two continuous chain loops with extended parallel sections on opposite sides of the tubing, in an opposing relationship. Each continuous chain carries a series of gripping elements. As each chain turns, the gripping elements come together on opposite sides of the tubing. A pair of skates, which include a long, straight and rigid beam that forces the grippers against the opposite sides of the tubing. The skates are pulled toward each other by hydraulic pistons or a similar mechanism to force the gripper elements against the tubing. Examples of coiled tubing injectors include those shown and described in U.S. Pat. No. 5,309,990, and U.S. applications Ser. Nos. 091070,592 and 09/070,593, all of which are incorporated herein by reference.

Coiled tubing has traditionally been used primarily for circulating fluids into the well and other work over operations, rather than drilling, because of its relatively small diameter and because it was not strong enough, especially for deep drilling. In recent years, however coiled tubing has been increasingly used to drill well bores. For drilling, a turbine motor is suspended at the end of the tubing and is driven by mud or drilling fluid pumped down the tubing. Coiled tubing has also been used as permanent tubing in production wells. These new uses of coiled tubing have been made possible by larger, stronger coiled tubing.

In order to handle larger, longer, and heavier tubing, the gripping force must be increased. Increased gripping force can be achieved by increasing the force pressing the gripper shoes against the tubing, the number of gripper shoes contacting the pipe, increasing the length of the chains, or the contact area of the gripper shoe. Increased gripping force can also be achieved through improving the gripping surfaces.

One problem with applying greater forces to the tubing is that dimensional variations of the components of the injector that are within manufacturing tolerances may nevertheless result in uneven gripping force applied to the tubing. For example, the position of a gripper element relative to the tubing may vary as the gripper elements moves on the injector's skate due to dimensional variations in the skate and rollers on which the gripper elements roll on the skate. Similarly, the position of the gripper element relative to the other gripper elements may also vary due to dimensional variations between the gripper elements, the elements of the chain and the elements used to attach the gripper element to the chain. The result of these dimensional variations is an uneven application of gripping force along the length of the tubing that is in the injector, resulting in less than maximum potential gripping force and less than satisfactory performance. The uneven application of force also results in excess stress placed on the tubing because all of the gripping force is being applied by certain grippers rather than distributed among all of the grippers. This excess force may cause undesirable deformation of the tubing. Excess stress and the strain associated with the deformation weakens the tubing and hastens its failure.

SUMMARY OF THE INVENTION

One objective of the invention is a coiled tubing injector that more evenly applies gripping force to tubing running through the injector, thereby overcoming the problems found in the prior art. Another object of the invention is a coiled tubing injector that is capable of applying a greater gripping force to tubing without damaging the tubing.

According to one aspect of the invention, dimensional variations in the elements of an injector that apply a gripping force to tubing are accommodated through a skate comprising a beam and a plurality of rollers mounted to the beam through a resilient pad. The beam applies a force to the rollers through the resilient pad, which in turn applies a force to gripper elements mounted to a rotating, continuous chain. The resilient material compresses to accommodate variations in the dimensions of the skate, rollers and gripper elements so that gripping surfaces of all gripper elements are better aligned with each other as they are pressed against the outside of the tubing, resulting in more even application of forces by each of the gripping elements against the tubing.

In one embodiment of the invention, a plurality of rollers are mounted to each of a plurality of carriers, and the carriers are retained on the beam, with resilient material between the carrier and the skate. Mounting a plurality of rollers on a carrier provides lateral stability while allowing close spacing between the rollers, as compared to a roller carrier with only one roller. The carriers and pad are slid into a slot formed along the length of the beam. This arrangement further permits limited twisting of the carrier against the resilient material in order to accommodate variations in the surface of the gripper element that rides on the rollers. The arrangement is also easy to install and maintain.

Another feature the invention solves a problem that arises when injectors are used to apply very large forces against tubing. A gripper element mounted on a chain in an injector must, as it moves past a sprocket on which the chain is mounted, turn to align with the tubing. At the point at which the gripper element rolls over a first roller of a skate, it is not aligned with the tubing. It must therefore pivot about the roller. Because the gripper element is rigid, its leading edge will extend into the path of the tubing as it is pivoting into alignment. The tubing will push against the gripper element, trying to force it to pivot into alignment. When applying large gripping forces to the chain, the tension in the chain is so high that the gripper element pinches the tubing, causing it to deform. The resulting strain will tend lead to premature failure of the tubing.

To solve this problem one embodiment of an injector in accordance with this aspect of the invention includes a skate, on which is mounted a plurality of rollers over which gripping elements roll. An end roller, rather than being mounted to the skate, is mounted on one end of a pivoting arm, which allows the roller to deflect away from the tubing. The arm is resiliently biased, such as by a spring, against the tension in the chain. However, it will deflect as the gripper element begins to pinch the tubing: the roller gives rather than the tubing.

These and other aspects and advantages of the invention will be apparent from the following detailed description of one or more embodiments of the invention, which are illustrated in the accompanying drawings.

DETAILED DESCRIPTION

In the following description, like numbers refer to like parts.

Figure 1:
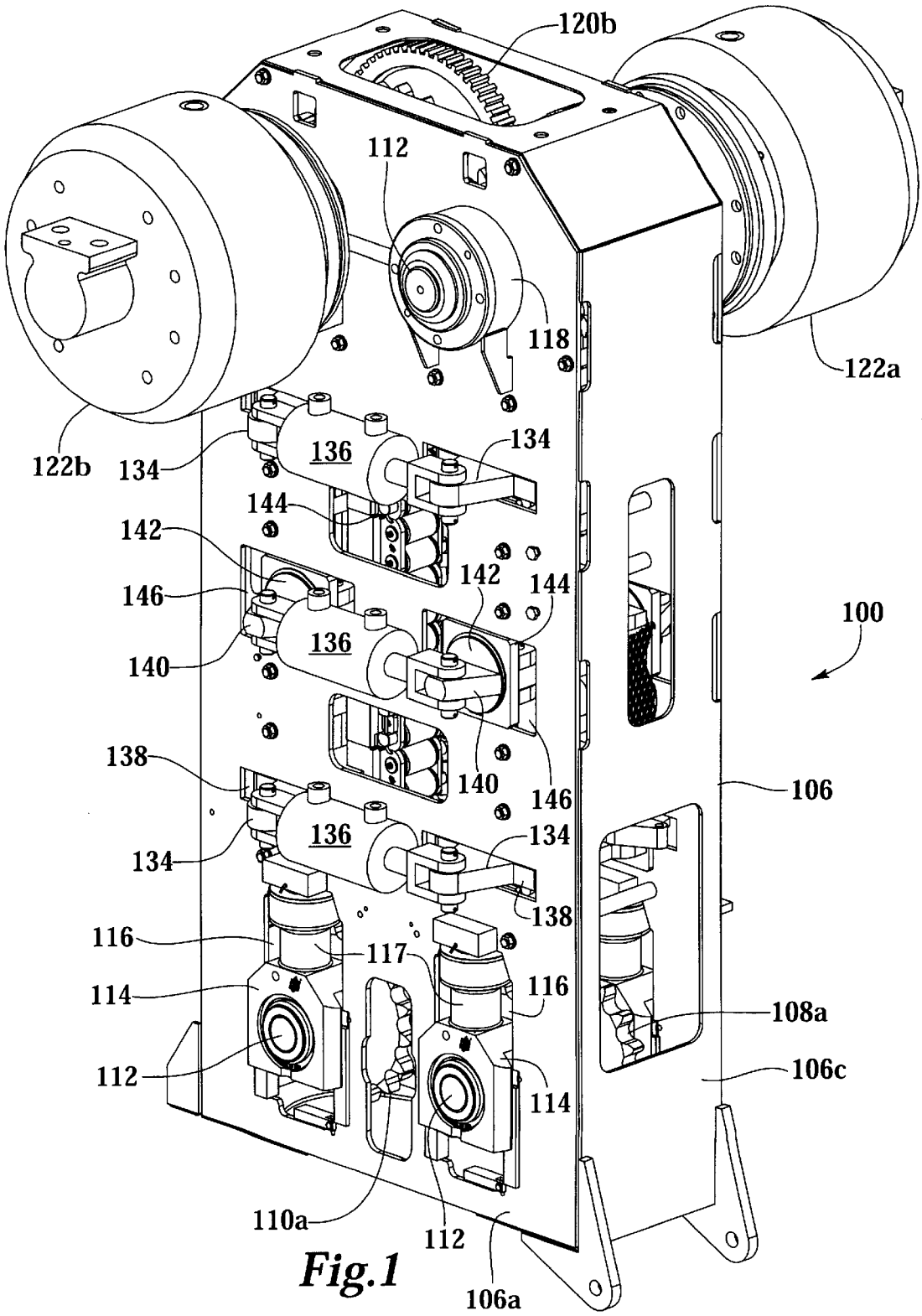
FIG. 1 is a perspective view of a coiled tubing injector.
Figure 2:
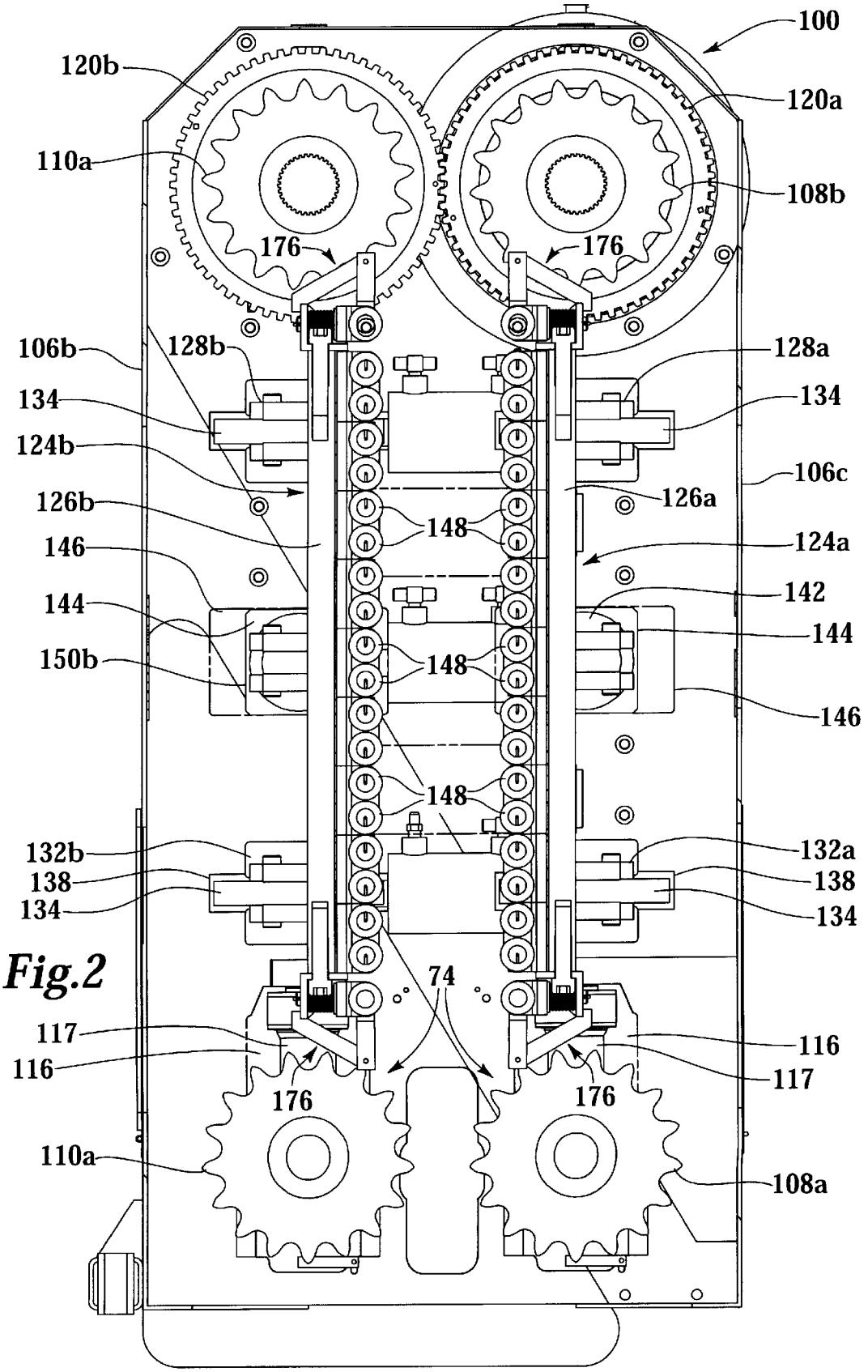
FIG. 2 is a front, elevational view of the coiled tubing injector of FIG. 1, placed within a cage for transport but with a front panel of its case and other components removed to reveal certain internal structures.

FIGS. 1 and 2 illustrate one embodiment of a coiled tubing injector 100. FIG. 1, but not FIG. 2, includes a front panel 106*a* of a case generally designated as 106. The front panel of the case has been removed in FIG. 2 for illustrating certain internal structures. Furthermore, in each figure, a gripper chain is not show in order to view other details of injector. The case also includes a front panel 106*a*, a back panel 106*d*, and side panels 106*b* and 102*c*.

Mounted in the case are two sets of sprockets. Sprockets 108*a* and 108*b* support one continuous roller chain on which the gripper elements are mounted (sometimes referred to as a gripper chain which is not shown. Sprockets 110*a* and 110*b* support a second gripper chain, which is also not shown. Sprockets 108*a* and 108*b* are mounted on axle 112 for rotation. Sprockets 110*a* and 110*b* are mounted on a drive shaft that is not visible in FIG. 1 or shown in FIG. 2. The drive shafts transmit power to the sprockets to turn the gripper chains. Each end of the axles on which sprockets 108*a* and 110*a* are mounted turn in bearings that are mounted in a sliding block 114. Each of the blocks 114 is keyed to slide along the inside edges of openings 116, which are formed in the front panel and back panels 106*a* and 106*d* of case 106. The drive shafts, on which sprockets 108*b* and 110*b* are mounted, are supported on one end by bearings mounted in a fixed (as opposed to sliding) fashion to the front and back panels of the case 106. Pocket 118, on the front panel 106*a*, carries one set of bearings for one end of the shaft for sprocket 108*b*. A similar pocket on the back panel carries bearings for the opposite end of the shaft for sprocket 110*b*. The other ends of the drive shafts are supported by another set of bearings that cannot be seen in these views.

Mounted on the same shafts as sprockets 108*b* and 110*b* are a set of timing gears 120*a* and 120*b*. The timing gears ensure synchronous rotation of the sprockets. The axles of sprockets 108*b* and 110*b* are coupled through transmissions 122*a* and 122*b*, respectively, to low speed, high torque, hydraulic motors that are not shown. Sprockets 108*a* and 110*a* are free to turn.

Between a top of each sliding block 114 and a top of each slot 116 is a hydraulic jack or cylinder 117. The jacks are used to move the axles of sprockets 108*a* and 110*a* downwardly, thereby applying greater tension to a gripper chain mounted on the sprockets.

Figure 3:
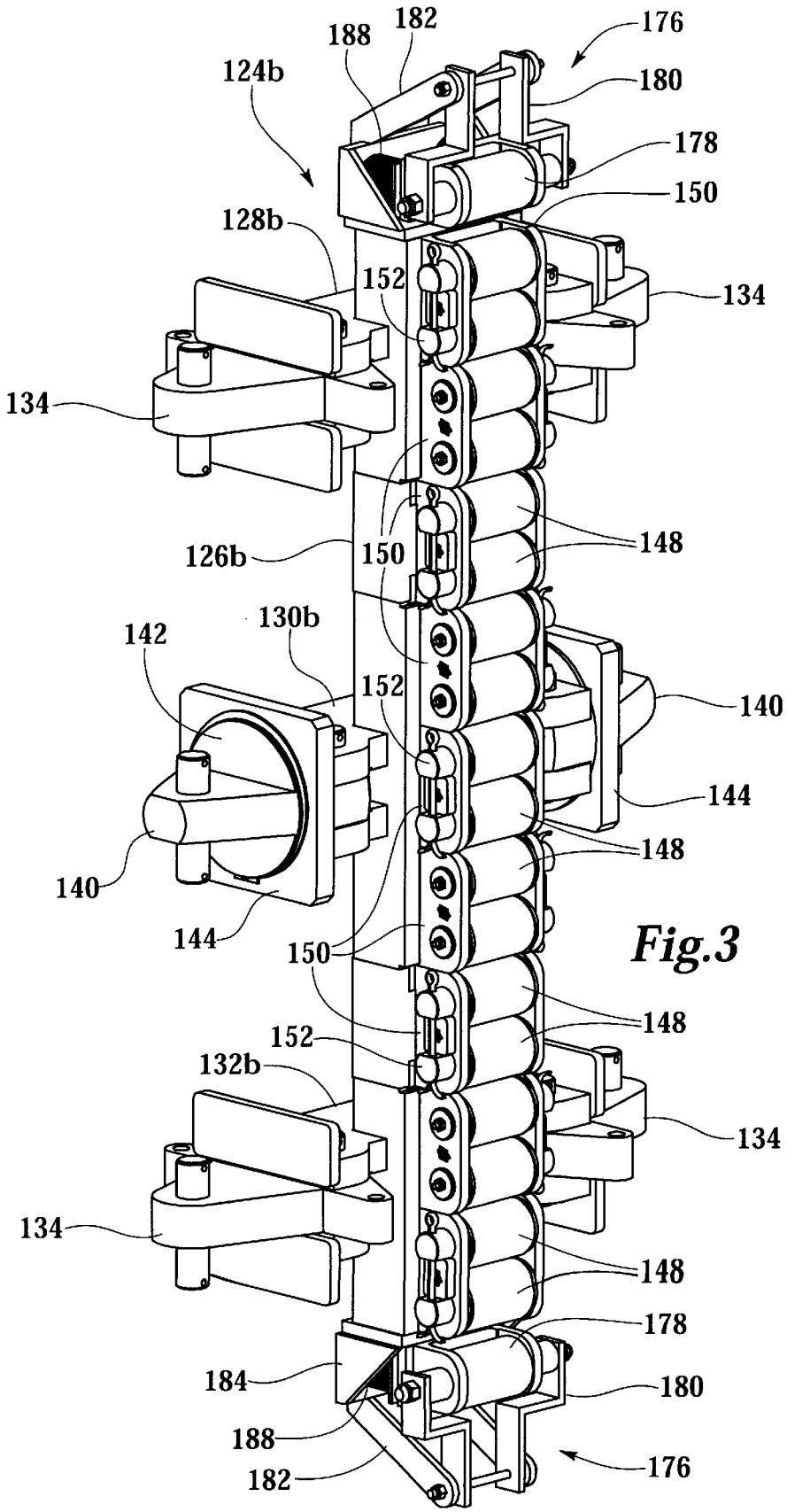
FIG. 3 is a perspective view of a skate for the coiled tubing injector of FIGS. 1 and 2.

Referring now to FIGS. 1, 2 and 3, inside case 106 are mounted two, opposing skates that are generally designated as 124*a* and 124*b*. Each skate 124*a* and 124*b* includes a stiff beam 126*a* and 126*b*, respectively. Behind each beam are a series of cross bars that extend from the front to the back of the case. Upper cross bars 128*a* and 128*b* and lower cross bars 132*a* and 132*b* are located at opposite ends of the beam. Cross bars 130*a* and 130*b* are further used to suspend or hang the skates within the case 106. Each cross bar is connected to a flange that extends through opening in the front and back panels of the case 106. Each flange is pivotally connected through a set of pins to one end of a hydraulic cylinder 136. The hydraulic cylinders, which are seen in FIG. 1, pull together each pair of cross bars, thereby pulling together the skates. As the skates are pulled together, they will press gripper chains (not shown in these figures; see FIG. 4) against tubing that is between the skates. Flanges 134, which are at the ends of the top and bottom cross bars 128*a* and 128*b*, and 132*a* and 132*b*, a free to move laterally within slots 138 to accommodate movement of the skates back and forth. Flanges 140, which are at the ends of cross bars 130*a* and 130*b*, includes a disk 142 that forms a journal for turning within block 144. Block 144 slides along slots 146, which are defined in the front and back panels of the case 106. The journalled disk permits the skates to rotate slightly about their midpoints within the case.

On the side of each beam 126*a* and 126*b* that faces the other beam are mounted a plurality of rollers 148. Referring now to FIGS. 3, 4, 5 and 5*a*, the rollers are retained on the beam in a manner that permits them to float: that is, their movement is constrained with respect to the beam to a limited range of motion. In the illustrated embodiment, the plurality of rollers are mounted for rotation on a plurality of roller carriers 150, which in turn are retained on the beam in a manner that permits limited lateral movement and rotation. As seen best in FIG. 5*a*, each roller 148 turns on an axle 152. Each axle 152 is mounted through openings in parallel flanges 154 of one of the roller carriers 150.

Each carrier 150 includes a pair of flanges 156. To retain the roller carriers, each beam has an elongated, vertical slot 157 in which the carriers are stacked. Also formed along the beam is a set of vertical grooves 158, which face inwardly, toward each other, to receive outwardly extending flanges 156 of the carriers 150. The slot and grooves are open at one end of each beam so that the carriers can be dropped into the slot for easy installation and removal. The thickness of the flanges 156 are less than the widths of the grooves 158, thereby allowing the carrier to move laterally a limited distance and to rotate slightly with respect to the beam. Alternately, the roller carriers may have, for example, inwardly facing flanges that engage outwardly facing grooves on the beam or that wrap behind the beam. As a further alternative, the grooves on each of the beams can, in effect, be inverted and replaced with a ridge or similar raised element that mates with a complementary groove or recessed element formed on the roller carrier.

Figure 4:
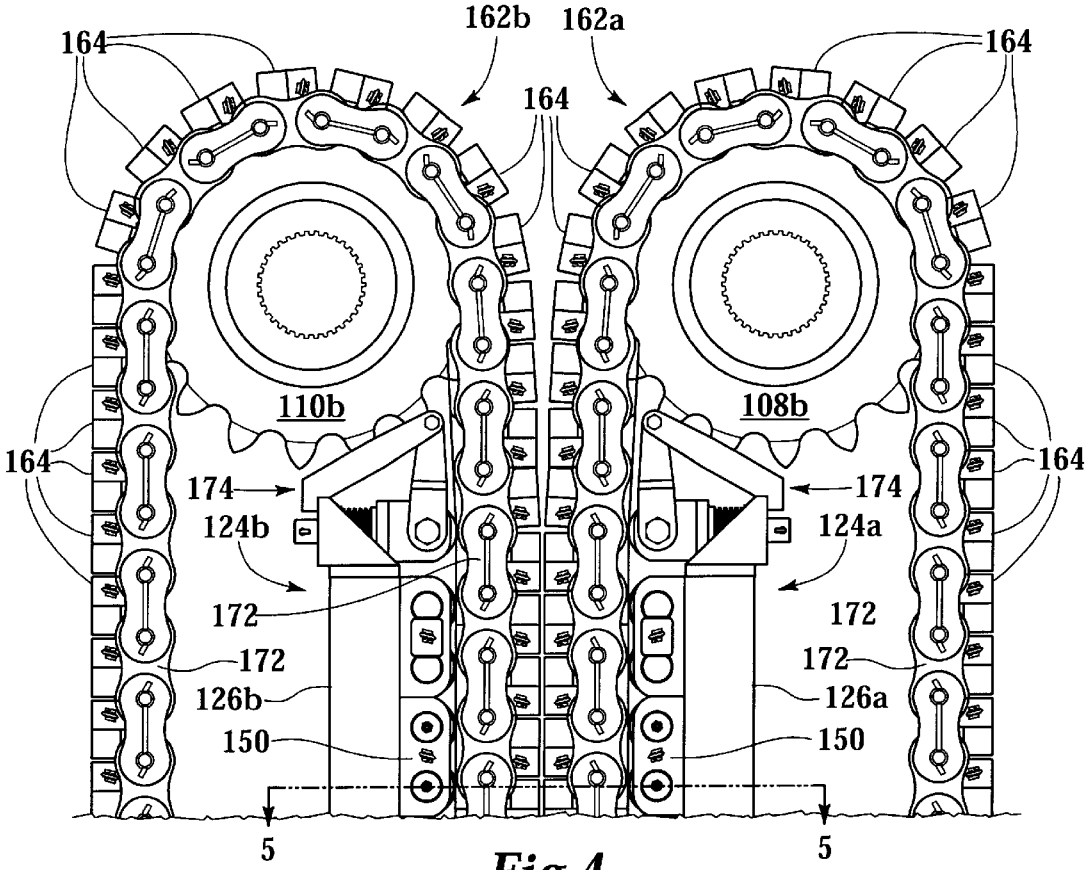
FIG. 4 is a side, elevational view of a portion of the coiled tubing injector of FIGS. 1 and 2 showing details of two gripper chains and skates, with several elements removed for clarity.
Figure 9:
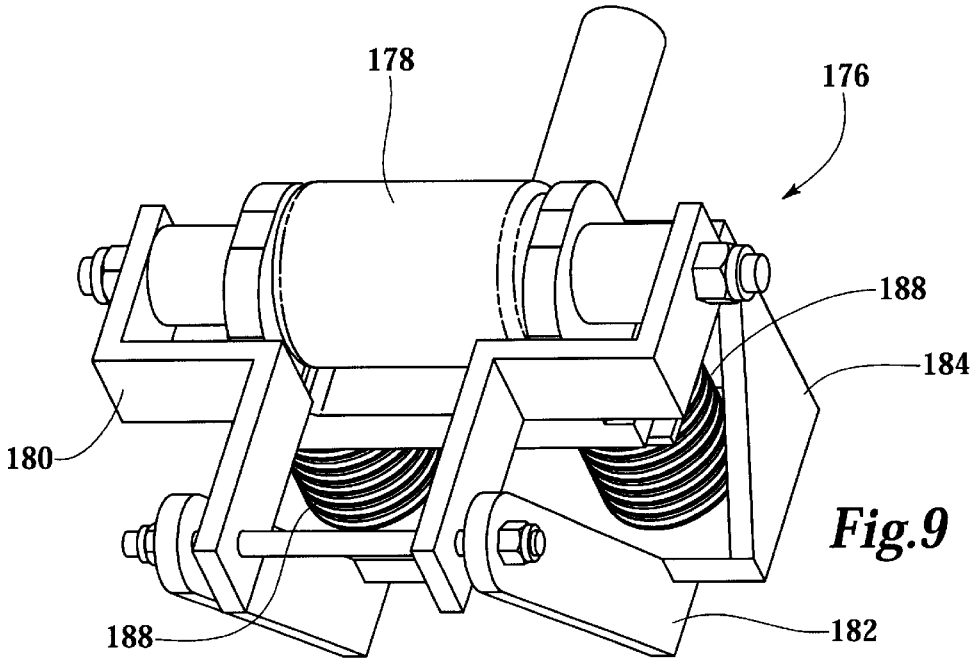
FIG. 9 is a perspective view of a pivoting roller assembly for the ends of the skates of the coiled tubing injector of FIGS. 1–8.
Figure 5:
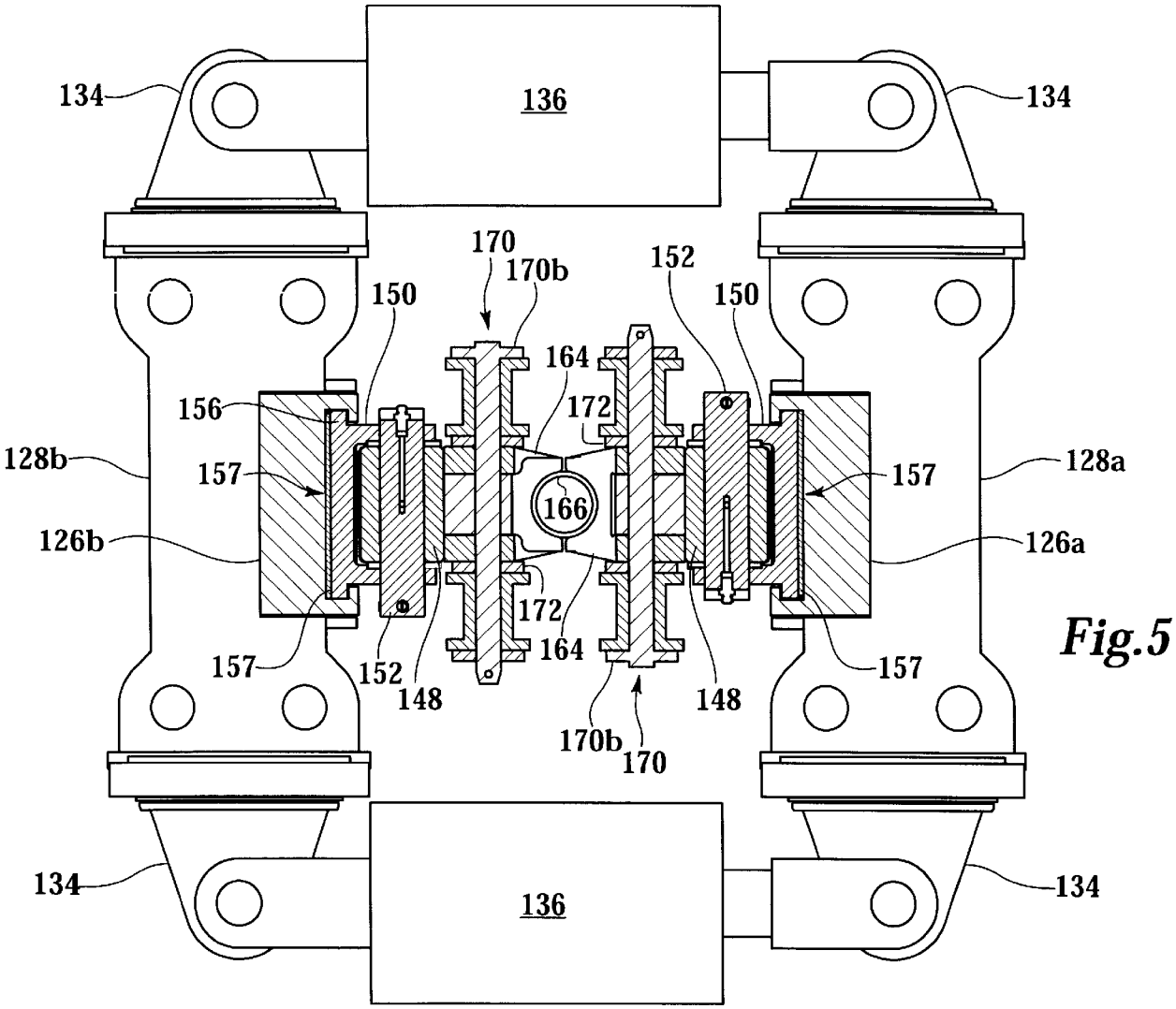
FIG. 5 is section through the skates and gripper chain of FIG. 4, taken along section line 5—5 in FIG. 4.
Figure 5A:
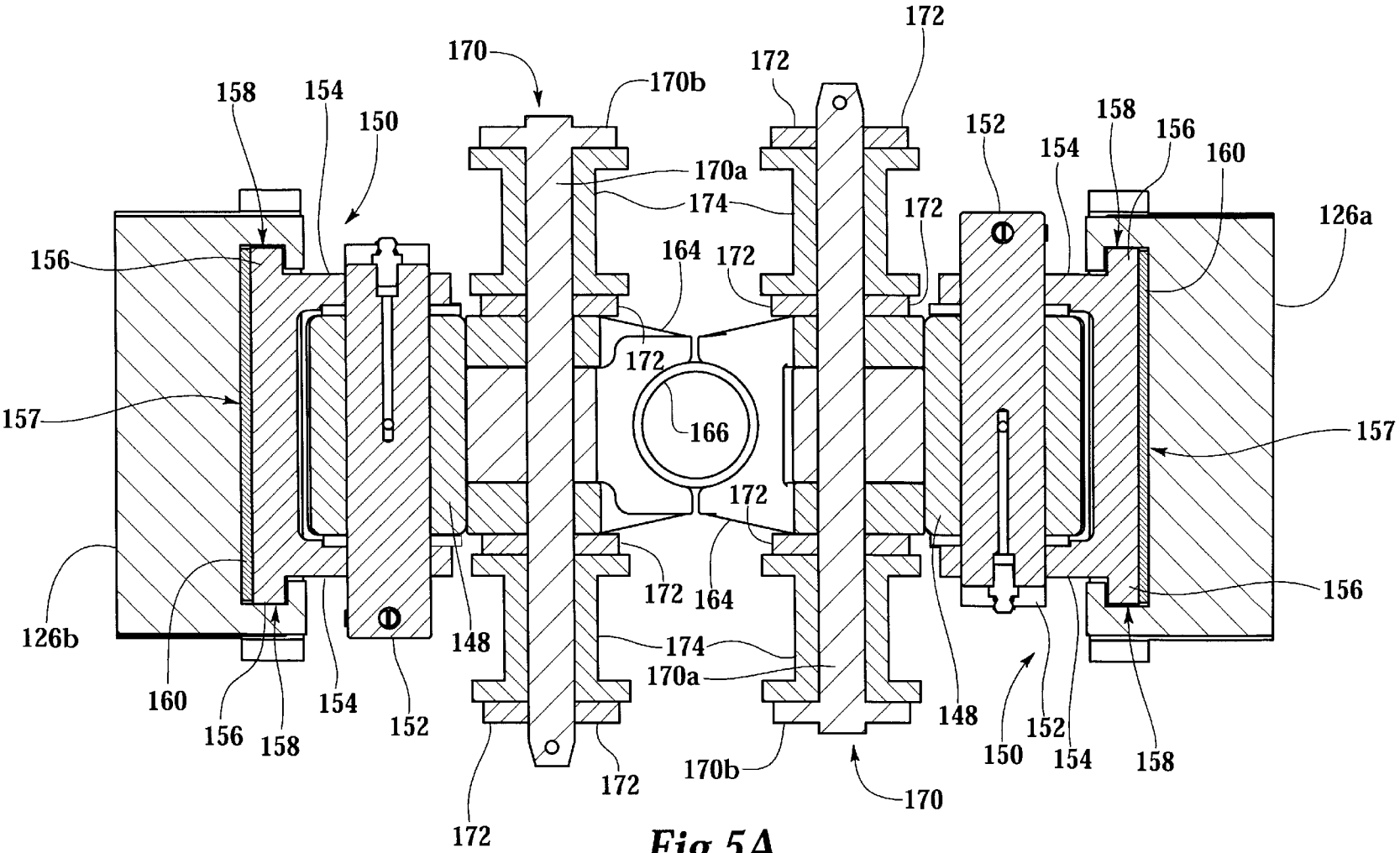
FIG. 5A illustrates a portion of FIG. 5 on a larger scale.
Figure 8:
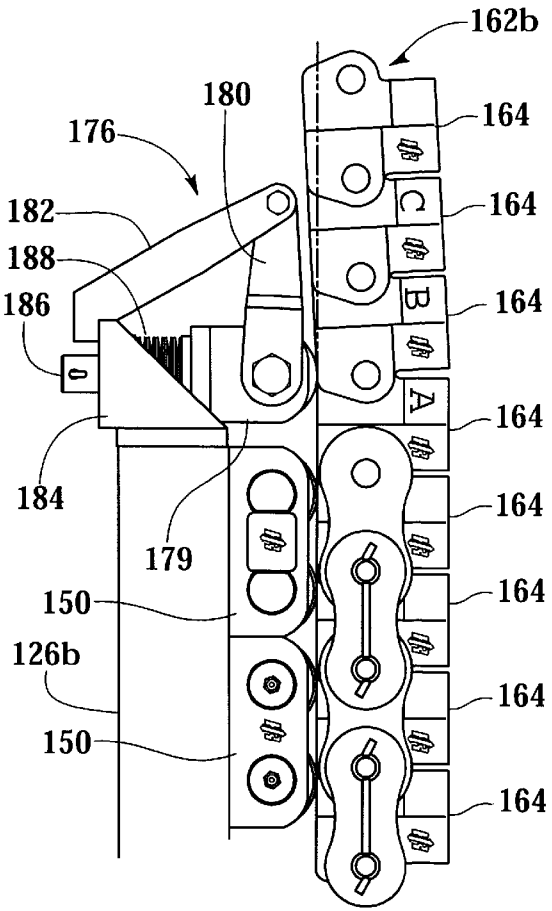
FIG. 8 is a side view of the gripper chain of FIG. 6 in a third, subsequent position.
Figure 7:
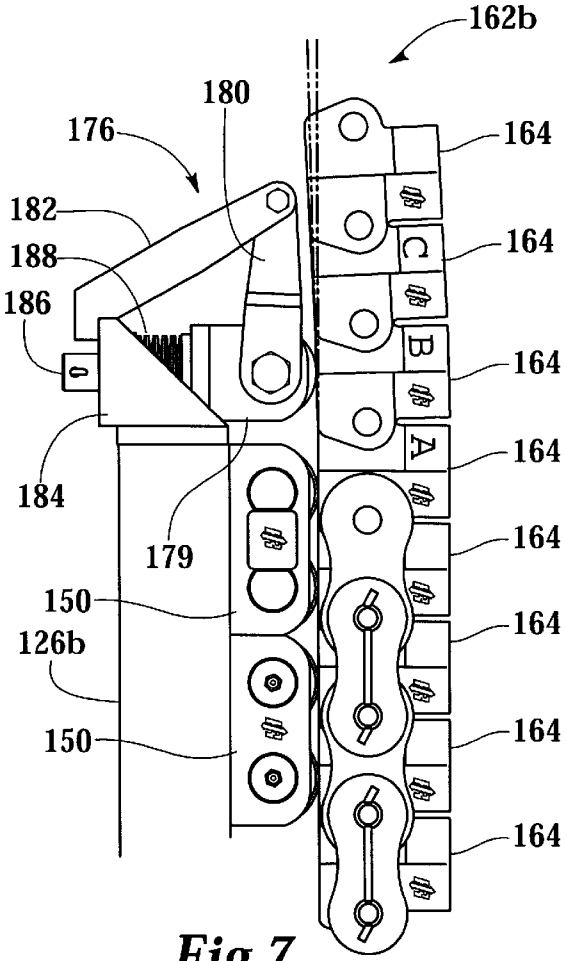
FIG. 7 is a side view of the gripper chain of FIG. 6 in a second, subsequent position.
Figure 6:
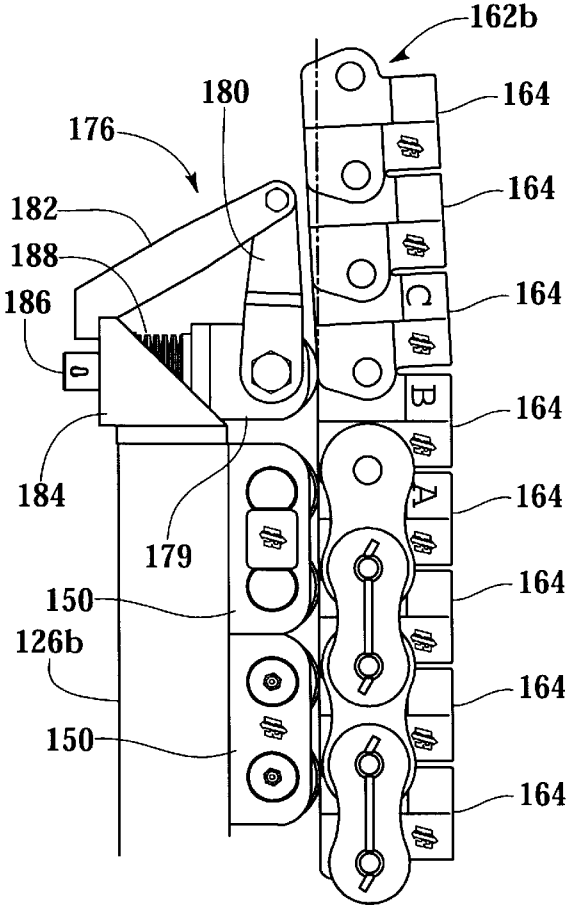
FIG. 6 is a side view of a portion of the skate and gripper chain for the coiled tubing injector of FIGS. 1–4, with the gripper chain in a first position.

Referring now only to FIGS. 4, 5 and 5*a*, a pad 160 comprised of a resilient material is located between each beam and the carriers 150 mounted on the beam. The pad can be slid into slot 157 for easy installation and removal. The resilient pad, which runs the length of beam behind the roller carriers, permits the roller carriers to be displaced laterally toward the beam against a spring force. The resilient pad generates a large spring force when compressed. The manner in which the roller carriers are mounted to the beam pad also permits the carriers to rock, such that one roller can be displaced more than the other roller on the same carrier.

Gripper chains 162*a* and 162*b* each include a plurality of gripper elements 164 mounted on a roller chain. The gripper elements are shaped to grip tubing 166 as it passes between the skates 124*a* and 124*b*. Each roller chain is formed by plurality of pin link plates 170, link plates 172, and rollers 174. Each pin link plate includes two integrated pins 170*a* and a link plate 170*b*. Rollers 174 are mounted on each end of each pin 170*a*, between a set of link plates. The pin also acts to retain the gripper element 164 on the chain by passing through the gripper element.

A back side of the gripper elements 164 roll on rollers 148 as they move across the skates. Small variations in the dimensions of each gripper element 164, roller carrier 150, and rollers 148, as well as variations in the dimension of the beams 126*a* and 126*b* along their respective lengths may result in a disproportionate application of force to tubing 166. Even though each element may be made to within acceptable manufacturing tolerances, the sum of the variations may result for a given gripper element at any given location along the skate in it a gripper element sticking out further toward the pipe than other gripper elements, thereby making it difficult to apply force to other gripping elements. At very high gripping pressures, the tubing may be deformed because of the unequal distribution of the load of the gripping forces. The strain of deformation will tend to lead to premature failure of the tubing, and may even damage the tubing. However, the resilient pad 160 between each of the beams 126*a* and 126*b* and the roller carriers 150 mounted on the respective beams will instead resiliently deform to the extent necessary. More gripper elements will therefore contact the tubing with the desired pressure, resulting in improved gripping of the tubing.

Although each roller carrier is shown with two rollers, one or more than two rollers could be used. Two carriers provides a wide base but allows for close spacing of the rollers and relatively fine accommodation of dimensional variations in the gripper chain along the length of the skate. Carriers with only a single roller can be used, but with a smaller base or wide spacing. Carriers with more than two rollers become long and are less able to accommodate dimensional variations that may be present between adjacent gripper elements.

Referring now to FIGS. 2, 3, 4, and 6 through 9, at each end of skates 124*a* and 124 is mounted a pivoting roller assembly 176. The pivoting roller assembly includes a roller 178. The roller and a bracket 179 are mounted to one end of swing arm 180. The swing arm pivots about the end of fixed arm 182. Fixed arm 182 is attached to mounting 184. Extending from the bracket 179 are pins 186, on which are stacked spring washers 188. The stacked spring washers act as a spring to bias the roller away from the beam. The purpose and function of the pivoting roller element is to allow the first and last rollers on the skate to deflect away from pipe as each gripper element 164 engages and disengages tubing. When each gripper element turns into, or out of, alignment with the plane of the skate, it pivots on the last roller of the skate, namely roller 178. During pivoting an edge of the gripper element it will tend move toward the axis of the tubing as the gripper element pivots on the roller. Without a deflection of the pivoting roller element, this pivoting of the gripper element would tend to cause the edge of the gripper element to dig into the tubing, momentarily deforming it. However, with the pivoting roller assembly, the tubing pushes back the roller 178, against the force of the spring washers 188, as the gripper element pivots. The stack of spring washers are compressed the distance necessary to allow a gripper element to pivot into alignment under a force that does not place undue or excess strain on the tubing. Because the spring washers will already be compressed under the load imposed by the tension in the chain, the spring constant of the stack of spring washers with this load should allow further compression to provide the clearance of the gripper elements under a force that avoids or reduces placing undue strain on the tubing.

The forgoing description is made in reference to exemplary embodiments of the invention. However, an embodiment may be modified or altered without departing from the scope of the invention, which scope is defined and limited solely by the appended claims.

What is claimed is:

1. A coiled tubing injector comprising:

a pair of continuous drive chains having opposed, elongated parallel runs spaced apart to form a path for engaging tubing passing therebetween;

a plurality of grippers disposed on each drive chain;

a pair of elongated beams, each beam extending behind one of the parallel runs of the pair of continuous drive chains;

a plurality of roller carriers retained on each of the beams, each roller carrier including at least one roller; and a resiliently compressible material disposed between the roller carriers and the beam.

2. The coiled tubing injector of claim 1 wherein each of the beams includes an elongated slot formed along the length of the beam, and the plurality of roller carriers are retained within the slots formed within the respective beams; and wherein the resiliently compressible material is disposed within the slot.

3. The coiled tubing injector of claim 1 wherein each of the plurality of carriers includes at least two rollers.

4. The coiled tubing injector of claim 1 wherein the beam further includes an elongated member running the length of the beam for mating with a complimentary member formed on the roller carriers for retaining the roller carriers on the respective beams, the elongated and complementary members allowing limited lateral movement of the roller carriers with respect to the beam.

5. The coiled tubing injector of claim 4 wherein the beam further includes an elongated slot running the length of the beam, and wherein the two elongated grooves are disposed within the slot.

6. The coiled tubing injector of claim 1 further comprising a pivotally mounted roller at each end of each skate, each pivotally mounted roller biased by a spring away from the beam.

7. A coiled tubing injector comprising:

a pair of continuous drive chains having opposed, elongated parallel runs spaced apart to form a path for engaging tubing passing therebetween;

a plurality of grippers disposed on each drive chain;

a pair of elongated beams, each beam extending behind one of the parallel runs of the pair of continuous drive chains;

a plurality of rollers retained along the length of each of the beams, over which the grippers roll; and a roller disposed on an end of each of the beams, the roller mounted to a swinging arm and biased away from the beam by a spring.

8. A coiled tubing injector comprising:

a pair of continuous drive chains having opposed, elongated parallel runs spaced apart to form a path for engaging tubing passing therebetween;

a plurality of grippers disposed on each drive chain;

a pair of elongated beams, each beam extending behind one of the parallel runs of the pair of continuous drive chains;

a plurality of roller carriers retained on each of the beams, each roller carrier including a roller;

wherein the beam further includes an elongated member running the length of the beam for mating with a complimentary member formed on each of the roller carriers for retaining the roller carriers on the respective beams, the elongated and complementary members allowing limited lateral movement of the roller carriers with respect to the beam; and a resiliently compressible material disposed between the roller carriers and the beam.

9. The coiled tubing injector of claim 8 wherein, each of the beams includes an elongated slot formed along the length of the beam and the plurality of roller carriers are retained within the slots formed within the respective beams;

the elongated member is disposed within the slot; and the resiliently compressible material is disposed within the slot.

* * * * *